US007673401B1

(12) United States Patent
Muti et al.

(10) Patent No.: US 7,673,401 B1
(45) Date of Patent: Mar. 9, 2010

(54) SNOW REMOVAL APPARATUS

(76) Inventors: Joseph J. Muti, 1280 Avalon Ct., Wheaton, IL (US) 60189; Anthony R. Muti, 604 S. Dunton, Arlington Heights, IL (US) 60005

( * ) Notice: Subject to any disclaimer, the term of this patent is extended or adjusted under 35 U.S.C. 154(b) by 0 days.

(21) Appl. No.: 12/323,023

(22) Filed: Nov. 25, 2008

(51) Int. Cl.
*E01H 5/02* (2006.01)

(52) U.S. Cl. ..... 37/265

(58) Field of Classification Search ..... 111/100–106, 111/7.1, 7.2, 92.95; 172/21, 22, 371–378; 37/265, 78, 284; 294/53.5, 51, 54.5, 59, 294/50.8, 50.9; 15/111, 117
See application file for complete search history.

(56) References Cited

U.S. PATENT DOCUMENTS

| | | | | |
|---|---|---|---|---|
| 1,143,752 | A | 6/1915 | Crisman | |
| 1,922,998 | A | 8/1933 | Williams | |
| 2,867,827 | A | 1/1959 | Gantz | |
| 4,760,807 | A * | 8/1988 | Keller | 111/92 |
| 5,309,654 | A | 5/1994 | Mathis | |
| 5,706,592 | A | 1/1998 | Sinclair, Jr. | |
| 5,727,829 | A * | 3/1998 | Bellichak | 294/51 |
| 5,908,255 | A | 6/1999 | Branch | |
| 6,289,828 | B1 * | 9/2001 | Wittenberg | 111/106 |
| 6,944,980 | B1 * | 9/2005 | Lefrancois | 37/285 |
| 7,347,468 | B1 * | 3/2008 | Tidcomb | 294/51 |

* cited by examiner

*Primary Examiner*—Robert E Pezzuto
(74) *Attorney, Agent, or Firm*—Crossley Patent Law; Mark A. Crossley

(57) ABSTRACT

The snow removal apparatus has a tubular handle having a first end spaced apart from a second end, a threaded cap selectively fitted to the second end. A cavity within the handle is extended from the second end to proximal to the first end. The scoop has a scoop front spaced apart from a scoop back, a first side spaced apart from a second side, the scoop back affixed to the first end of the handle. An outlet exits the handle first end and is joined to the scoop back. The scoop has a floor extended from the scoop back to the scoop front and from the first side to the second side. A button is disposed on the handle for selectively releasing a material from the cavity into the scoop, such materials useful in snow melt and in aiding auto traction, for example. The bristles disposed on the scoop front are especially useful in snow removal from auto glass.

7 Claims, 4 Drawing Sheets

SNOW REMOVAL APPARATUS

BACKGROUND OF THE INVENTION

Snow removal from automobiles is often necessary, yet few tools are suited well to the task. A proper tool should include a scoop. Additionally, the scoop should be uniquely tapered for best snow gathering and removal. Also, a brush is often needed, especially in snow removal from windows. The present apparatus provides a scoop with relatively high rear wall and a bottom taper for best snow gathering into the scoop. The apparatus further provides a brush. The present apparatus also provides a button-controlled cavity handle which can be used to dispense salt or sand to aid in melting snow and ice and to aid with traction when needed.

FIELD OF THE INVENTION

The snow removal apparatus relates to snow removal tools and more especially to a snow removal apparatus especially suited to automobiles.

SUMMARY OF THE INVENTION

The general purpose of the snow removal apparatus, described subsequently in greater detail, is to provide a snow removal apparatus which has many novel features that result in an improved snow removal apparatus which is not anticipated, rendered obvious, suggested, or even implied by prior art, either alone or in combination thereof.

To attain this, the snow removal apparatus is especially suited to snow removal from automobiles. The bottom taper and double-slanted sides of the scoop gather snow effectively to be held within the scoop until emptied. The rear wall of the scoop is elevated to hold a volume of snow effectively. The apparatus is ideally sized for auto use, with a length of about 8 inches and a width of about 10 inches. Size is found to be important, in that too small a size cannot hold enough snow, and too large a size is not easily used on an auto, especially due to curved surfaces and window and other glass sizes and curves. The bristles are especially effective on snow removal from the auto's glass. The handle provides easy-to-use button dispensing of dry material stored in the handle cavity. Salt and sand are but two useful materials potentially held within the handle cavity.

Thus has been broadly outlined the more important features of the improved snow removal apparatus so that the detailed description thereof that follows may be better understood and in order that the present contribution to the art may be better appreciated.

An object of the snow removal apparatus is to remove snow from an automobile.

Another object of the snow removal apparatus is to remove ice from an automobile.

A further object of the snow removal apparatus is to be especially effective in snow removal from auto glass.

An added object of the snow removal apparatus is to provide for melting ice.

And, an object of the snow removal apparatus is to provide for enhancing auto traction.

These together with additional objects, features and advantages of the improved snow removal apparatus will be readily apparent to those of ordinary skill in the art upon reading the following detailed description of presently preferred, but nonetheless illustrative, embodiments of the improved snow removal apparatus when taken in conjunction with the accompanying drawings.

In this respect, before explaining the current embodiments of the improved snow removal apparatus in detail, it is to be understood that the snow removal apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved snow removal apparatus. It is therefore important that the claims be regarded as including such equivalent constructions insofar as they do not depart from the spirit and scope of the snow removal apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the snow removal apparatus generally designated by the reference number 10 will be described.

Figure 1:
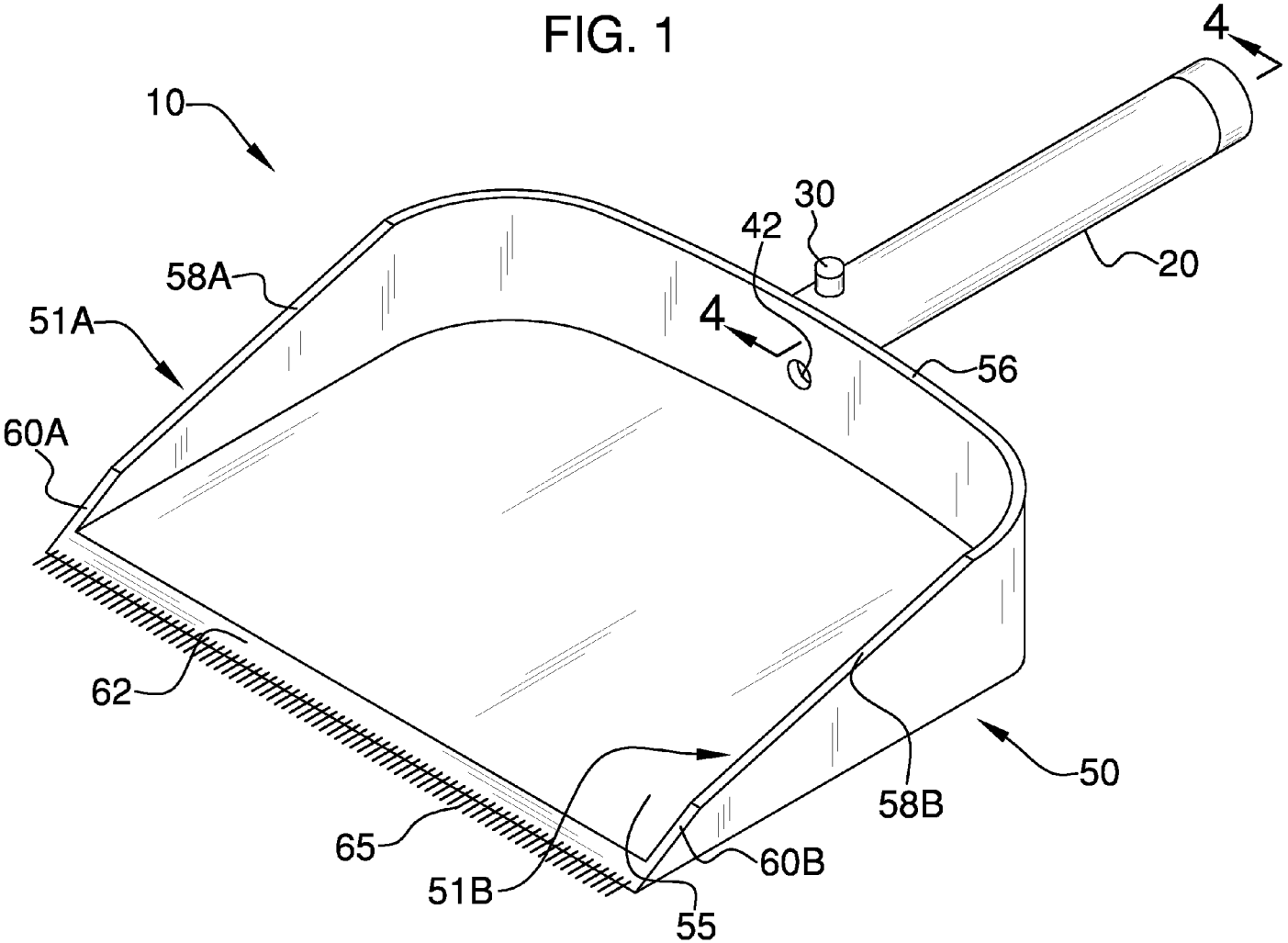
FIG. 1 is a perspective view.
Figure 2:
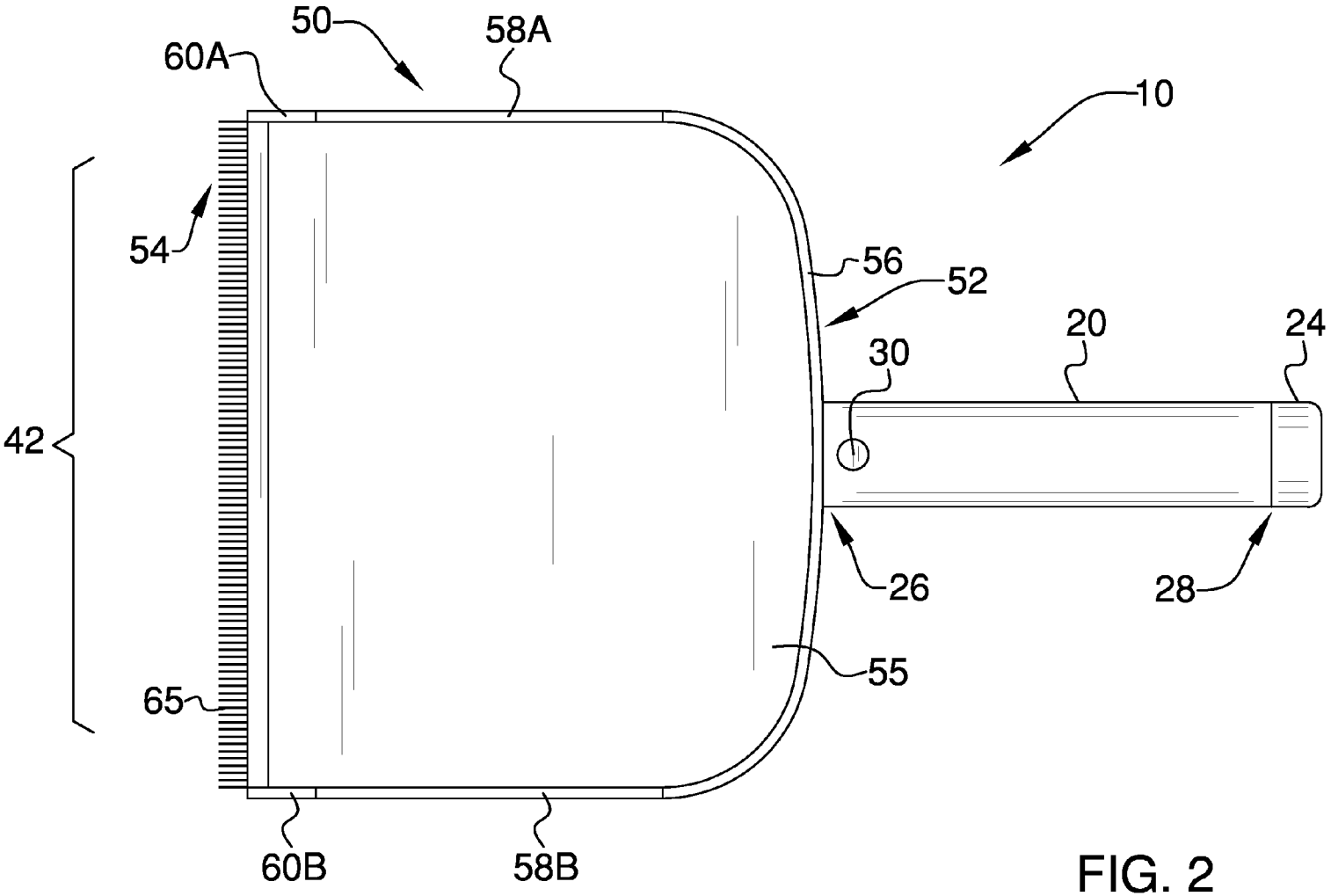
FIG. 2 is a top plan view.
Figure 5:
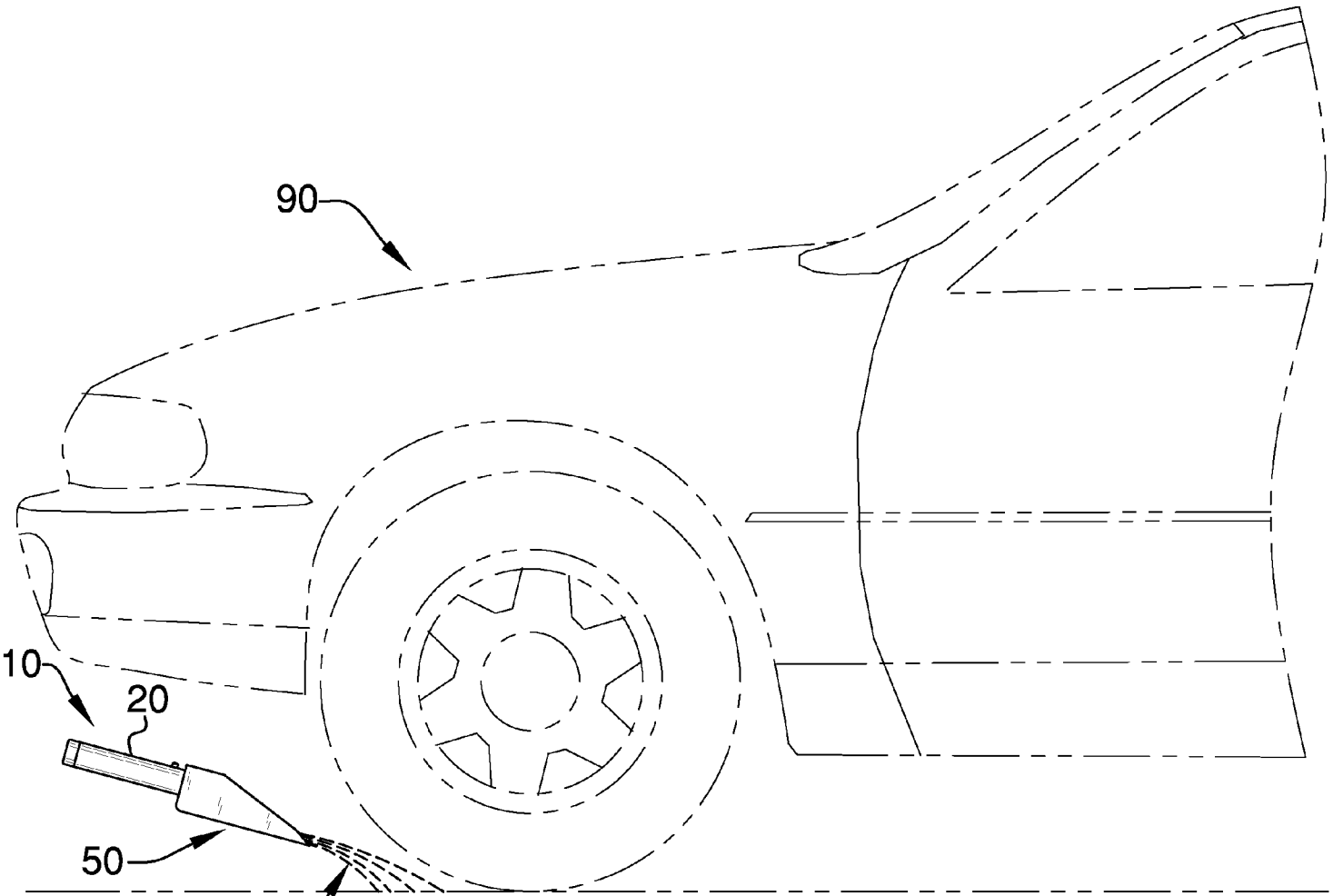
FIG. 5 is a lateral elevation view of the apparatus spreading sand.

Referring to FIG. 5, the snow removal apparatus 10 is in use spreading sand 80 to improve the automobile's 90 traction. The tubular handle 20 may also be filled with salt or other chemicals such as magnesium chloride, as chosen. Referring to FIGS. 1 and 2, the apparatus partially comprises the tubular handle 20 having a first end 26 spaced apart from a second end 28. The scoop 50 has a scoop front 54 spaced apart from the scoop back 52. The scoop 50 first side 51*a* is spaced apart from the scoop 50 identical second side 51*b*. The scoop back 52 is affixed to the first end 26 of the handle 20. The outlet 42 is joined to the scoop back 52. The scoop 50 further comprises the floor 55 extended from the scoop back 52 to the scoop front 54 and from the first side 51*a* to the second side 51*b*. The first side 51*a* further comprises the lower first slant 60*a* extended angularly and upwardly from the bottom taper 62. The lower first slant 60*a* is joined to the first upper slant 58*a*. The first upper slant 58*a* is joined to the elevated rear wall 56 disposed at the scoop back 52. The scoop 50 second side 51*b* is identical to the first side 51*a*. The second side 51*b* further comprises the lower second slant 60*b* extended angularly and upwardly from the bottom taper 62. The lower second slant 60*b* is joined to a second upper slant 58*b*. The second upper slant 58*b* is joined to the elevated rear wall 56. The rear wall 56 is higher than the first upper slant 58*a* and second upper slant 58*b*. The bottom taper 62 is disposed on the scoop front 54 floor 55. The plurality of bristles 65 is disposed horizontally outwardly on the bottom taper 62. The bottom taper 62 provides for scooping snow and ice off of an automobile 90.

The bottom taper 62, lower slants, and upper slants channel snow into the scoop back 52 to be held by the elevated rear wall 56 until emptied by a user. The bristles 65 provide for brushing snow from an automobile 90 and are especially suited to removal of snow from glass surfaces. The total width 72 of the apparatus 10 is about 10 inches.

Figure 3:
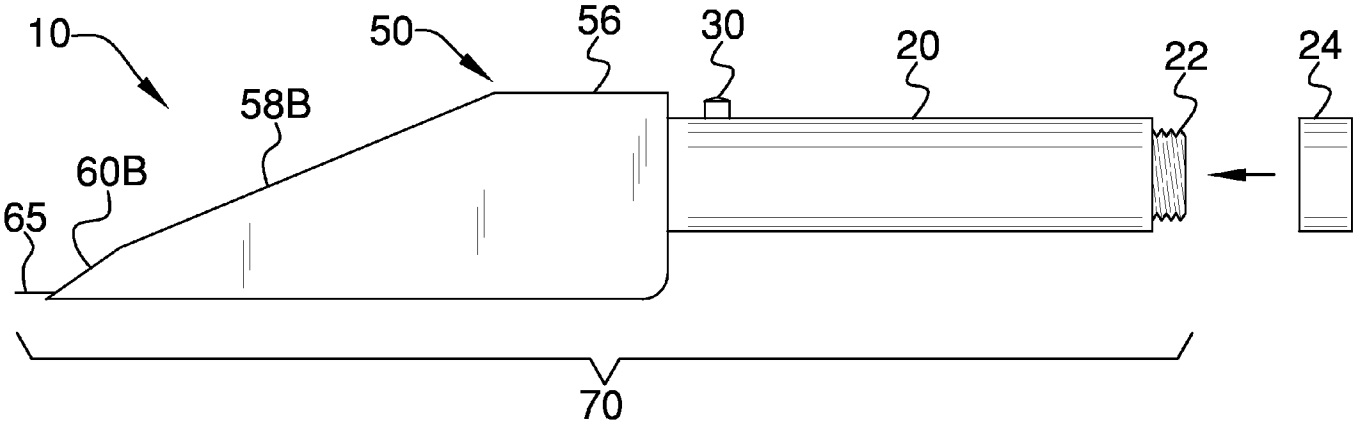
FIG. 3 is a lateral elevation view.
Figure 4:
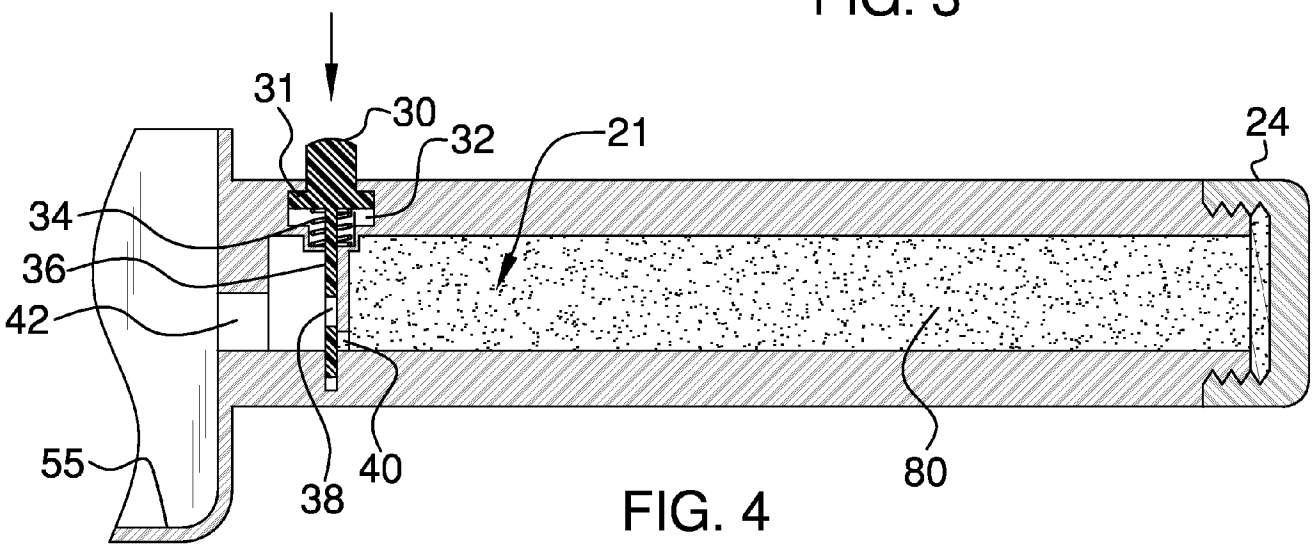
FIG. 4 is a partial cross sectional view of FIG. 1, taken along the line 4-4.

Referring to FIGS. 3 and 4, the male thread 22 is disposed on the handle 20 second end 28. The threaded cap 24 is selectively fitted to the male thread 22. The cavity 21 is disposed within the handle 20. The cavity 21 is extended from the second end 28 to proximal to the first end 26 of the handle 20. The outlet 42 is disposed within the first end 26 of the handle 20. The cavity gate 40 is disposed between the cavity 21 and the outlet 42. The button channel 32 is disposed within the handle 20 proximal to the cavity gate 40. The dispense button 30 is slideably disposed within the button channel 32. The button shoulder 31 captures the dispense button 30 within the button channel 32. The button shaft 36 is extended downwardly from the dispense button 30. The button shaft 36 is immediately adjacent to the cavity gate 40. The button gate 38 is disposed within the button shaft 36. The button gate 38 is selectively disposed in alignment with the cavity gate 40 via dispense button 30 depression. Material from within the cavity 21 is thereby selectively released through the cavity gate 40, through the selectively aligned button gate 38, and out of the outlet 42. The total length 70 of the apparatus 10 is about 8 inches. The compression spring 34 resists dispense button 30 depression.

With respect to the above description then, it is to be realized that the optimum dimensional relationships for the parts of the snow removal apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the snow removal apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the snow removal apparatus may be used.

Therefore, the foregoing is considered as illustrative only of the principles of the snow removal apparatus. Further, since numerous modifications and changes will readily occur to those skilled in the art, it is not desired to limit the snow removal apparatus to the exact construction and operation shown and described, and accordingly, all suitable modifications and equivalents may be resorted to, falling within the scope of the snow removal apparatus.

What is claimed is:

1. A snow removal apparatus, comprising:

a tubular handle having a first end spaced apart from a second end;

a male thread disposed on the handle second end;

a threaded cap selectively fitted to the male thread;

a cavity within the handle, the cavity extended from the second end to proximal to the first end;

a scoop having a scoop front spaced apart from a scoop back, a first side spaced apart from a second side, the scoop back affixed to the first end of the handle, the outlet joined to the scoop back adjacent to a center of the scoop back, the scoop further comprising:

a floor extended from the scoop back to the scoop front, from the first side to the second side;

a bottom taper disposed on the scoop front floor;

a plurality of bristles disposed horizontally outwardly on the bottom taper;

means for selectively releasing a dry material from the cavity into the scoop.

2. The apparatus according to claim 1 wherein the means for selectively releasing a dry material from the cavity into the scoop further comprises a dispense button.

3. A snow removal apparatus, comprising:

a tubular handle having a first end spaced apart from a second end;

a male thread disposed on the handle second end;

a threaded cap selectively fitted to the male thread;

a cavity within the handle, the cavity extended from the second end to proximal to the first end;

a scoop having a scoop front spaced apart from a scoop back, a first side spaced apart from a second side, the scoop back affixed to the first end of the handle, the scoop further comprising:

a floor extended from the scoop back to the scoop front, from the first side to the second side;

a bottom taper disposed on the scoop front floor;

a plurality of bristles disposed horizontally outwardly on the bottom taper;

the first side further comprising a lower first slant extended angularly and upwardly from the bottom taper, the lower first slant joined to a first upper slant, the first upper slant joined to an elevated rear wall disposed at the scoop back;

the second side identical to the first side, the second side further comprising a lower second slant extended angularly and upwardly from the bottom taper, the lower second slant joined to a second upper slant, the second upper slant joined to the elevated rear wall, the rear wall higher than the first upper slant and second upper slant;

an outlet within the first end of the handle, the outlet in communication with the cavity and the scoop, the outlet adjacent to a center of the scoop back;

means for selectively releasing a dry material from the cavity into the scoop.

4. A snow removal apparatus, comprising:

a tubular handle having a first end spaced apart from a second end;

a male thread disposed on the handle second end;

a threaded cap selectively fitted to the male thread;

a cavity within the handle, the cavity extended from the second end to proximal to the first end;

an outlet within the first end of the handle;

a cavity gate disposed between the cavity and the outlet;

a button channel disposed within the handle proximal to the cavity gate;

a dispense button slideably disposed within the button channel, a button shoulder on the dispense button capturing the dispense button within the button channel;

a button shaft extended downwardly from the dispense button, the button shaft adjacent to the cavity gate;

a button gate within the button shaft, the button gate selectively disposed in alignment with the cavity gate, a dry material from within the cavity selectively released from the outlet via dispense button depression;

a compression spring resisting downward pressure of the dispense button;

a scoop having a scoop front spaced apart from a scoop back adjacent to a center of the scoop back, a first side spaced apart from a second side, the scoop back affixed to the first end of the handle, the outlet joined to the scoop back, the scoop further comprising:

a floor extended from the scoop back to the scoop front, from the first side to the second side;

a bottom taper disposed on the scoop front floor;

a plurality of bristles disposed horizontally outwardly on the bottom taper;

the first side further comprising a lower first slant extended angularly and upwardly from the bottom taper, the lower first slant joined to a first upper slant, the first upper slant joined to an elevated rear wall disposed at the scoop back;

the second side identical to the first side, the second side further comprising a lower second slant extended angularly and upwardly from the bottom taper, the lower second slant joined to a second upper slant, the second upper slant joined to the elevated rear wall, the rear wall higher than the first upper slant and second upper slant.

5. The apparatus according to claim 4 wherein a total length of the apparatus is about 8 inches.

6. The apparatus according to claim 4 wherein a total width of the apparatus is about 10 inches.

7. The apparatus according to claim 5 wherein a total width of the apparatus is about 10 inches.

* * * * *